US006569611B2

(12) United States Patent
Haller et al.

(10) Patent No.: US 6,569,611 B2
(45) Date of Patent: May 27, 2003

(54) COLOR PHOTOGRAPHIC SILVER HALIDE MATERIAL

(75) Inventors: Jan Haller, Leverkusen (DE); Ralf Wirowski, Köln (DE)

(73) Assignee: AGFA-Gevaert (BE)

( * ) Notice: Subject to any disclaimer, the term of this patent is extended or adjusted under 35 U.S.C. 154(b) by 0 days.

(21) Appl. No.: 10/043,760

(22) Filed: Jan. 10, 2002

(65) Prior Publication Data

US 2002/0172900 A1 Nov. 21, 2002

(30) Foreign Application Priority Data

Jan. 15, 2001 (DE) ..... 101 01 393

(51) Int. Cl.[7] ..... G03C 1/46
(52) U.S. Cl. ..... 430/504; 430/361
(58) Field of Search ..... 430/504, 361

(56) References Cited

U.S. PATENT DOCUMENTS

| | | | | |
|---|---|---|---|---|
| 4,184,876 A | | 1/1980 | Eeles et al. | 430/505 |
| 4,306,015 A | | 12/1981 | Haylett | 430/382 |
| 4,705,744 A | | 11/1987 | Sasaki et al. | 430/505 |
| 5,270,152 A | | 12/1993 | Hall | 430/360 |
| 5,389,499 A | | 2/1995 | Hall | 430/359 |
| 5,466,566 A | | 11/1995 | Tashiro et al. | 430/505 |
| 6,010,839 A | * | 1/2000 | Crawley et al. | 430/558 |
| 6,132,943 A | * | 10/2000 | Younathan et al. | 430/504 |

FOREIGN PATENT DOCUMENTS

| | | |
|---|---|---|
| DE | 25 30 645 | 1/1976 |
| EP | 167 173 | 1/1986 |
| EP | 550 110 | 7/1993 |

* cited by examiner

*Primary Examiner*—Hoa Van Le
(74) *Attorney, Agent, or Firm*—Connolly, Bove Lodge & Hutz LLP

(57) ABSTRACT

A color photographic silver halide material having a support, which material comprises at last one blue-sensitive, yellow-coupling silver halide emulsion layer and at least one green-sensitive, magenta-coupling silver halide emulsion layer and at least one red-sensitive, cyan-coupling silver halide emulsion layer, and which contains at least one masking coupler which has two chromophores which absorb in the wavelength range from 420 to 750 nm and are eliminable or decolorizable by coupling with the developer oxidation product, is distinguished by improved sensitivity associated with undiminished color purity.

22 Claims, No Drawings

COLOR PHOTOGRAPHIC SILVER HALIDE MATERIAL

This invention relates to a color photographic silver halide material having a support and at least three differently sensitised photosensitive silver halide emulsion layers, which material contains a novel masking coupler.

In color photographic negative films, color saturation and color reproduction are adjusted to the desired value in the individual layers by the interplay between DIR couplers and masking couplers.

A typical color negative film contains closest to the light source at last one blue-sensitive, yellow-coupling silver halide emulsion layer and, further away from the light source than the at least one blue-sensitive layer, at least one green-sensitive, magenta-coupling silver halide emulsion layer and at least one red-sensitive, cyan-coupling silver halide emulsion layer.

Due to this arrangement, masking couplers are known which couple from yellow to magenta and are located in a green-sensitive layer, as are masking couplers which couple from yellow to cyan or from magenta to cyan and are located in a red-sensitive layer. Conventional masking couplers are accordingly those which couple from a dye having a short wavelength absorption maximum to a dye having a longer wavelength absorption maximum.

Reverse coupling in the opposite direction, for example from cyan to magenta is known from U.S. Pat. No. 5,466,566, but has not hitherto been implemented in practice.

Using DIR reduces the sensitivity of a color photographic material; the DIR coupler for example by the action of the inhibitor released from it, which is required to improve color purity, and both types by consumption of developer oxidation product.

The object of the invention was to avoid or at least reduce these disadvantages.

It has now surprisingly been found that this object is achieved with a masking coupler which has two chromophores which absorb in the wavelength range from 420 to 750 nm and are eliminable or decolorisable by coupling with the developer oxidation product. The chromophores may absorb at identical or very similar wavelengths or at different wavelengths.

A very similar wavelength means that the absorption maxima of the two chromophores differ by no more than 30 nm; a different wavelength means that the absorption maxima of the two chromophores differ by at least 30 nm.

The object is in particular achieved with a masking coupler which exhibits an absorption maximum in two of the three ranges of the spectrum to which the readout sensor (photographic paper, semiconductor sensor) is sensitive, i.e. both in the blue and the green range or both in the blue and the red range or both in the green and the red range.

The dye produced by coupling may have its absorption maximum in any desired absorption range.

The coupler according to the invention preferably couples to yield a dye with an absorption maximum in the remaining, third range of the spectrum.

If, for example, the masking coupler absorbs blue and red light, it preferably couples to yield magenta, the complementary color to green.

Particularly preferred masking couplers are those which absorb blue and green light and couple to cyan, and masking couplers which absorb blue and red light and couple to magenta.

The maximum absorption of the masking coupler for red light preferably corresponds to the spectral red sensitivity of a readout sensor, which is in a functional relationship with the silver halide recording material, wherein, for example, a color photo-graphic paper or a scanner may act as the readout sensor.

For the purposes of this invention, functional relationship means that a scene recorded with the material according to the invention is read out by the readout sensor, for example by an analogue exposure through the color negative obtained from the material according to the invention onto the color paper as readout sensor, or by reading out the image information of the color negative by means of a semiconductor sensor, for example by means of a CCD, as the readout sensor.

The masking coupler is in particular of the formula (I)

Kup-Farb-1-Farb-2 (I)

in which

Kup means the residue of a color coupler

Farb-1 means the residue of a first chromophore, in particular a fragment which, together with Kup, forms a dye and Farb-2 means the residue of a second chromophore.

Under chromogenic processing conditions, the color couplers may in particular yield colorless, magenta, yellow, red or cyan compounds or compounds which can be rinsed out during processing.

Magenta-coupling masking couplers are preferably of the formulae (II) and (III):

(II)

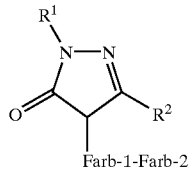

(III)

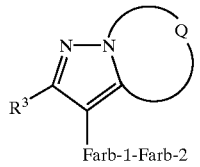

in which $R^1$ means unsubstituted phenyl or phenyl mono- or polysubstituted by halogen, alkyl, cyano, alkoxy, alkoxycarbonyl or acylamino, $R^2$ means alkylamino, arylamino, acylamino or carbamoylamino $R^3$ means a hydrogen atom or a substituent and Q means the non-metallic atoms to complete a 5-membered azole ring with 2 to 4 nitrogen atoms, which ring may be substituted.

Preferably, $R^1$ means phenyl substituted by one or more halogen atoms, in particular 2,4,6-trichlorophenyl, 2,5-dichlorophenyl or 2-chlorophenyl, and $R^2$ means aryl-amino or acylamino.

The couplers of the formula (III) in particular comprise pyrazolo[1,5-b]-[1,2,4]-triazoles or pyrazolo[5,1-c]-[1,2,4] triazoles.

Cyan-coupling masking couplers are preferably of the formula (IV):

(IV)

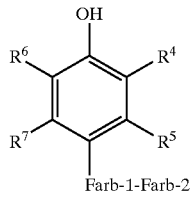

in which $R^4$ bis $R^7$ mean hydrogen atoms or substituents. $R^4$ and $R^5$ or $R^6$ and $R^7$ may be linked together to form a ring.

A preferred formula is (V)

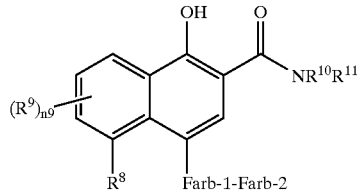

in which $R^8$ means a hydrogen atom or a substituent such as acylamino, sulfonylamino or alkoxycarbonylamino, $R^9$ means a substituent, n9 means a number from 0 to 3 and $R^{10}$ and $R^1$ means hydrogen atoms or substituents, which may be linked together to form a ring, in particular alkyl or aryl.

Furthermore, in the formula (IV)

$R^4$ preferably means acylamino or carbamoylamino, $R^5$ and $R^6$ preferably mean hydrogen atoms and $R^7$ preferably means acylamino.

Yellow-coupling masking couplers are preferably of the formula (VI):

(VI)

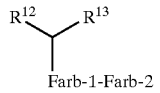

in which $R^{12}$, $R^{13}$ mean electron acceptor groups such as acyl, alkoxycarbonyl, aryloxy-carbonyl, carbamoyl, cyano, nitro, sulfamoyl, alkylsulfonyl, arylsulfonyl, aryl or heterocyclic groups, which may be joined together into a ring.

Preferably, $R^{12}$ means $CONHR^{14}$, wherein $R^{14}$ represents a substituted phenyl, and $R^{13}$ means $COR^{15}$, wherein $R^{15}$ represents tert.-butyl, 4-methoxyphenyl or 1-ethyl-cyclopropyl.

At least one of the residues $R^1$ and $R^2$ in the formula (II), one of the residues $R^3$ or Q in the formula (III), one of the residues $R^4$ to $R^7$ in the formula (IV) or one of the residues $R^{12}$ and $R^{13}$ in the formula (VI) preferably contains a ballast group which renders the masking coupler emulsifiable in a coupler solvent and which keeps the dye arising on color development sufficiently hydrophobic to remain in the coupler solvent.

If none of the above-stated residues contains a ballast group, but instead a water-solubilising group, the dye formed on development then becomes water-soluble, is washed out and the masking coupler acts as a masking coupler which couples to colorless.

Suitable coupler residues Kup are stated below, wherein the coupling site, simultaneously the bonding site to Farb-1, is indicated "Farb-1".

Farb-1 may be a dye or a fragment which forms a dye with Kup, which fragment is attached to the coupling position of Kup via a sulfur, nitrogen or oxygen atom. Farb-1 may contain one or more time control members, which means that, once the bond between Kup and Farb-1 has been cleaved during chromogenic development, the residue Farb-1-Farb-2 breaks down into one or more fragments in time-delayed manner. If Kup contains a ballast residue, Farb-1 or Farb-2 should contain a ballast residue in order to render the masking coupler diffusion-resistant.

Farb-1 is preferably attached to Kup with an azo group, such that Kup-Farb-1 is a dye which absorbs in a different range of the spectrum than does the dye arising from Kup on development.

Examples of Farb-1 groups are listed below. Kup and Farb-2 are also stated in order to indicate the position of Farb-1 unambiguously.

Farb-2 is preferably a chromophore having an absorbance coefficient at 690 nm which is preferably at least 30% higher than at 620 nm. Farb-2 is in particular an azomethine dye comprising a coupler residue, conventional in photography, of the formulae (VII) to (XII) and a phenylenediamine developer moiety of the formula (XIII)

(VII)

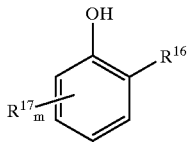

(VIII)

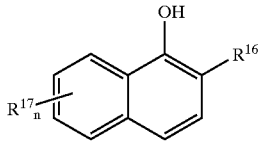

(IX)

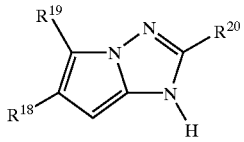

(X)

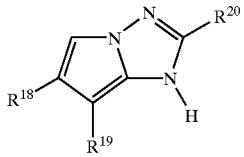

(XI)

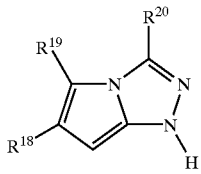

-continued (XII)

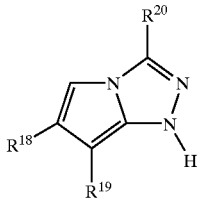

in which $R^{16}$ means H, $SO_2NR^{21}R^{22}$, $SO_3R^{21}$, $CO_2R^{21}$, $CONR^{21}R^{22}$, $NHCOR^{22}$, $NHCONR^{21}R^{22}$, $NHSO_2NR^{21}R^{22}$, $NHSO_2R^{21}$, hetaryl, $R^{17}$ means a substituent, $R^{18}$, $R^{19}$, $R^{20}$, $R^{21}$, $R^{22}$ mutually independently mean H or a substituent, wherein $R^{18}$ and $R^{19}$ or $R^{21}$ and $R^{22}$ may be linked together to form a ring, m means 0–2, n means 0–4, (XIII)

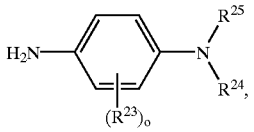

in which $R^{23}$ means a substituent, in particular alkyl, alkoxy, acylamino, $R^{24}$, $R^{25}$ mean alkyl, aryl or hetaryl or $R^{23}$ and $R^{24}$ together or $R^{24}$ and $R^{25}$ together mean the remaining members of a ring, in particular a 5- or 6-membered ring and o means a number from 0 to 4 and Farb-2 is linked to Farb-1 with one of the substituents $R^{16}$ to $R^{20}$ or $R^{23}$ to $R^{25}$ and one of the residues $R^{16}$ to $R^{20}$, $R^{23}$ to $R^{24}$ or the residue Farb-1, provided that it remains linked with Farb-2 after chromogenic development, preferably contains at least one water-solubilising group, for example a sulfonic acid, sulfonamide, carboxylic acid, carbonamide, hydroxy, polyether, amino or phosphorus-containing acid group, in order to rinse out the Farb-2 or Farb-1-Farb-2 fragment.

Sulfonic acid and carboxylic acid groups are preferred. $R^{16}$ to $R^{20}$ and $R^{23}$ to $R^{26}$ are not ballasted.

Examples of Farb-1 are (Farb-1)1

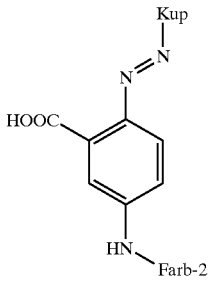

-continued (Farb-1)2

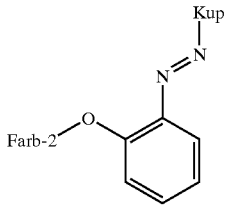

(Farb1-)3

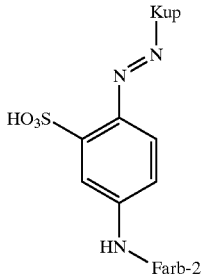

(Farb-1)4

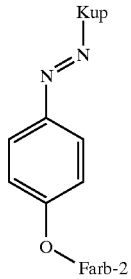

(Farb-1)5

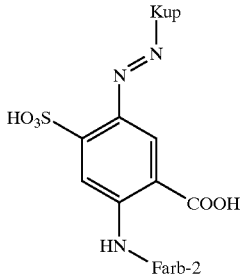

(Farb-1)6

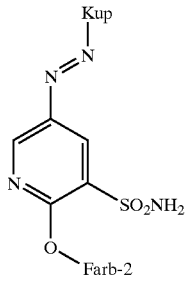

-continued
(Farb-1)7
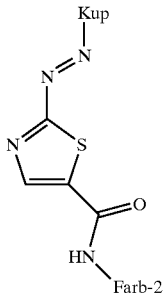
(Farb-1)8
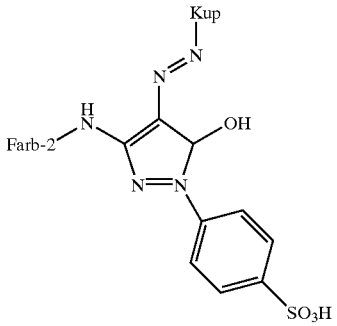
(Farb-1)9
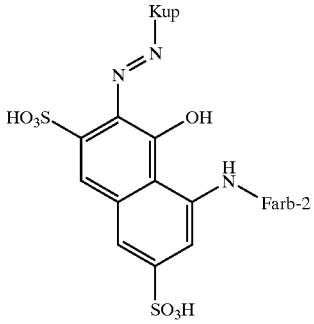
(Farb-1)10
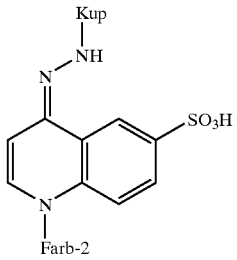
(Farb-1)11
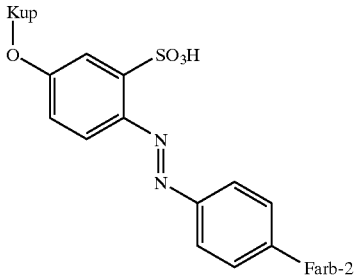
-continued
(Farb-1)12
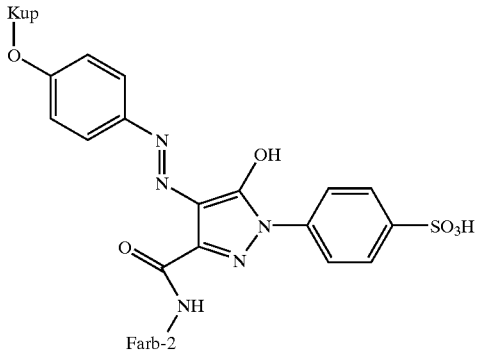
(Farb-1)13
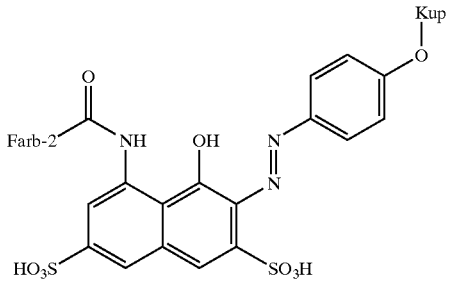
(Farb-1)14
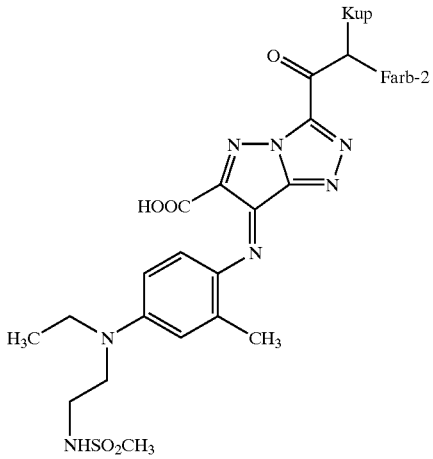
(Farb-1)15
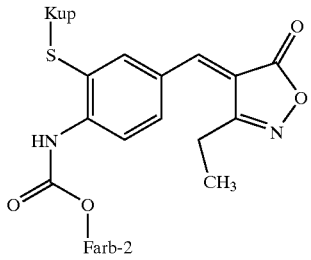

-continued
(Farb-1)16
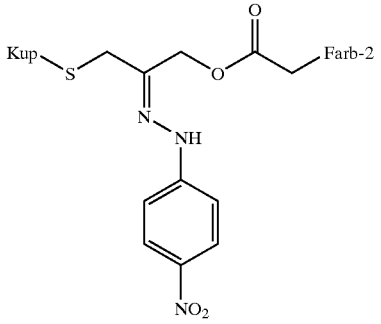
(Farb-1)17
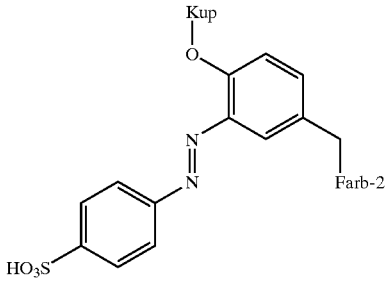
-continued
(Farb-1)18
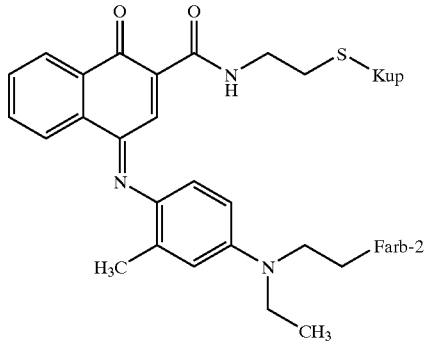
Examples of Farb-2 are listed below.
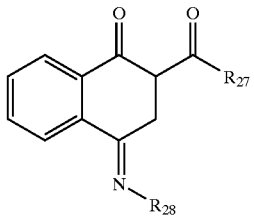
(Farb-2)1
$R^{27}$ =
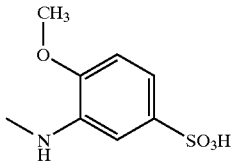
$R^{28}$ =
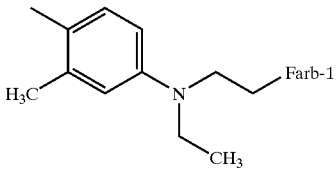
(Frb-2)2
$R^{27}$ =
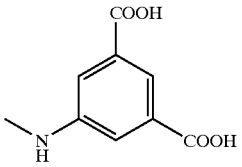
$R^{28}$ =
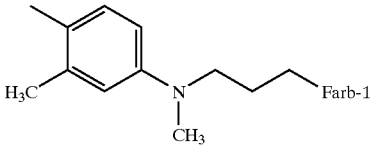
(Farb-2)3
$R^{27}$ =
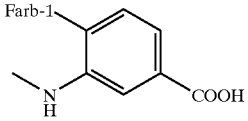
$R^{28}$ =
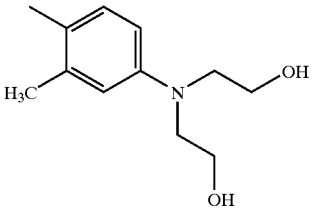

-continued
(Farb-2)4
$R^{27}$ =
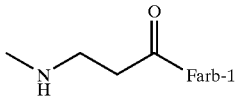
$R^{28}$ =
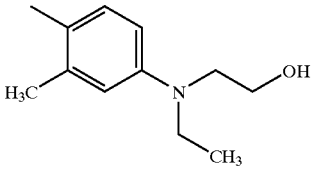
(Farb-2)5
$R^{27}$ =
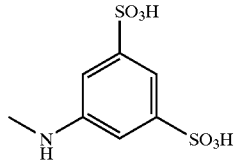
$R^{28}$ =
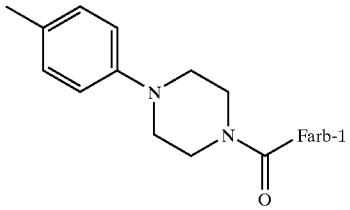
(Farb-2)6
$R^{27}$ =
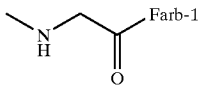
$R^{28}$ =
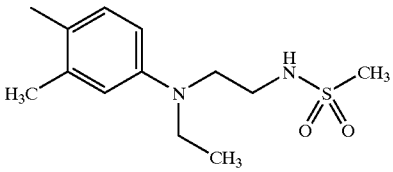
(Farb-2)7
$R^{27}$ =
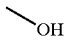
$R^{28}$ =
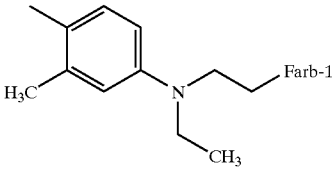
(Farb-2)8
$R^{27}$ =
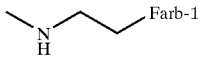
$R^{28}$ =
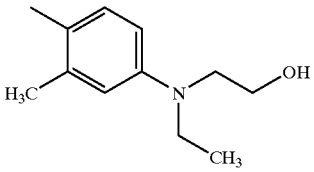
(Farb-2)9
$R^{27}$ =
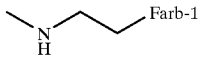
$R^{28}$ =
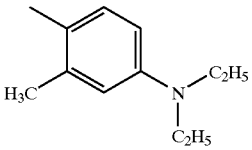
(Farb-2)10
$R^{27}$ =
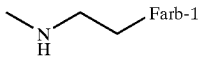
$R^{28}$ =
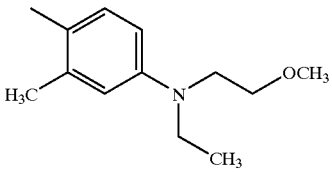
(Farb-2)11
$R^{27}$ =
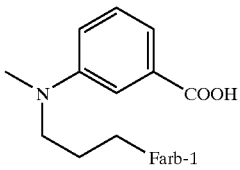
$R^{28}$ =
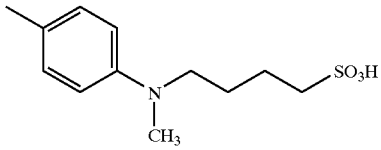

-continued
(Farb-2)12
$R^{27}$ =
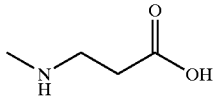
$R^{28}$ =
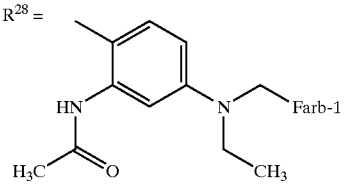
(Farb-2)13
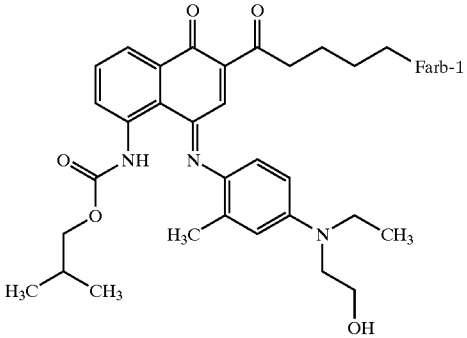
(Farb-2)14
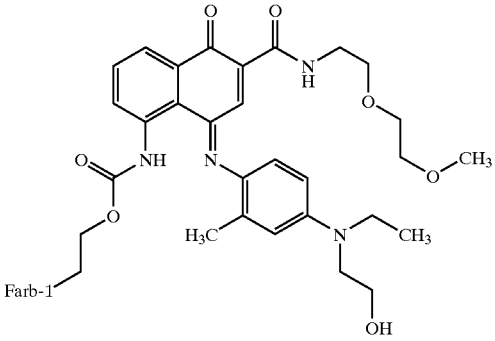
(Farb-2)15
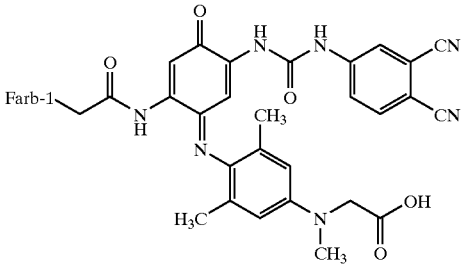
(Farb-2)16
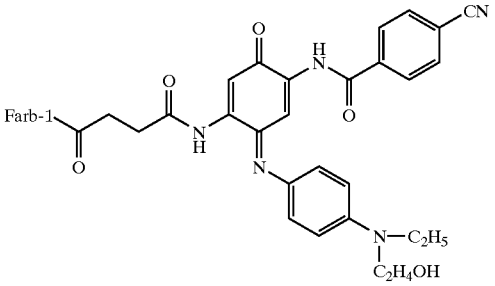
(Farb-2)17
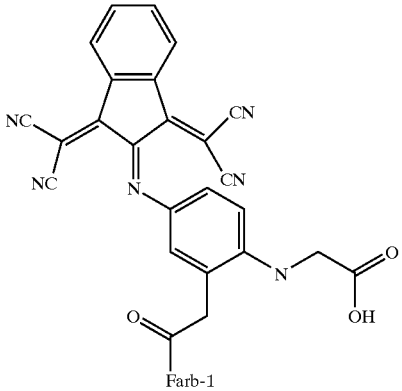
(Farb-2)18
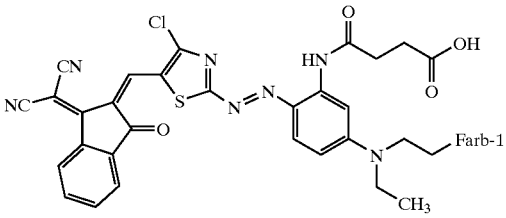
(Farb-2)19
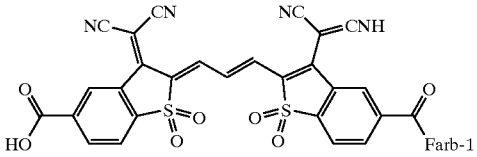
(Farb-2)20
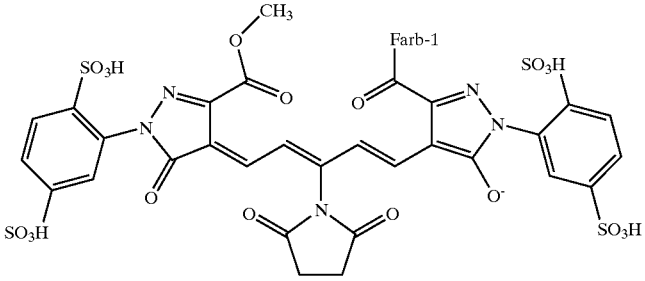

-continued
(Farb-2)21
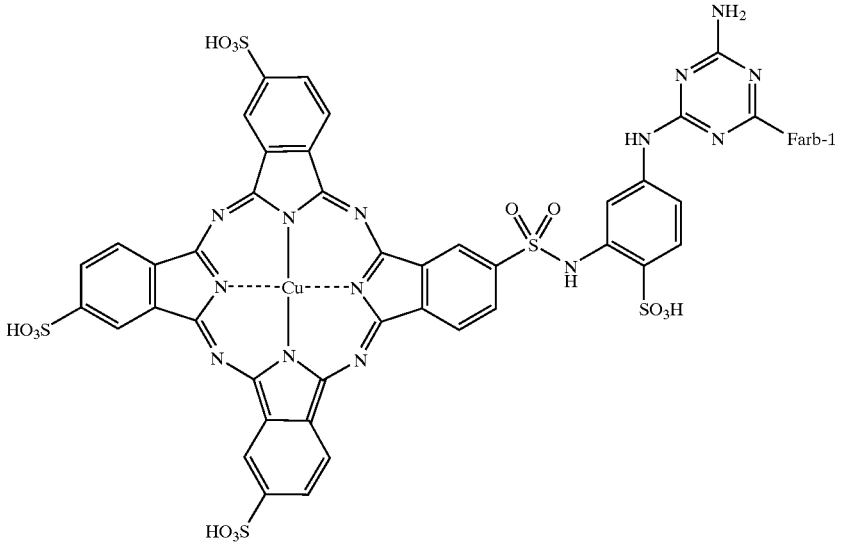
(Farb-2)22
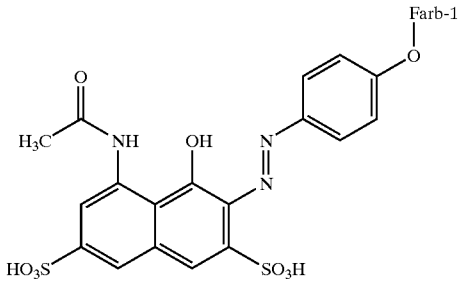
(Farb-2)23
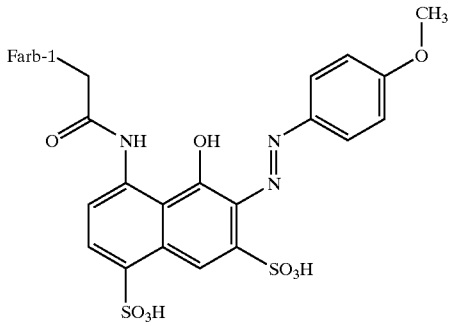
(Farb-2)24
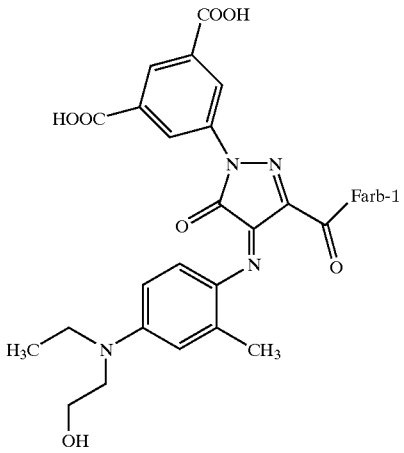
(Farb-2)25
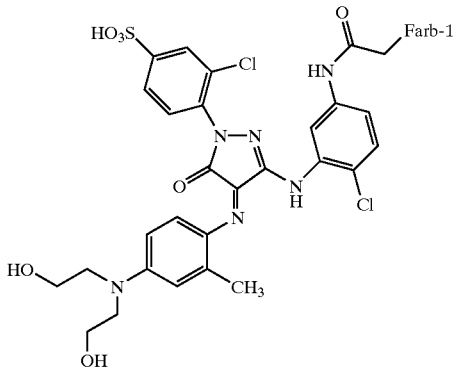

-continued
(Farb-2)26
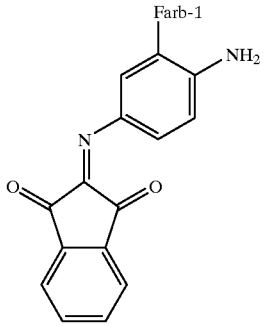
(Farb-2)27
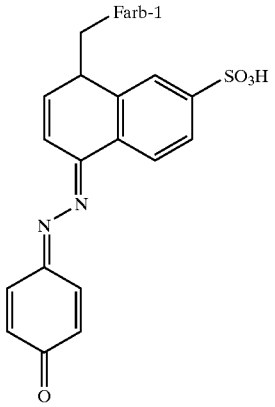
(Farb-2)28
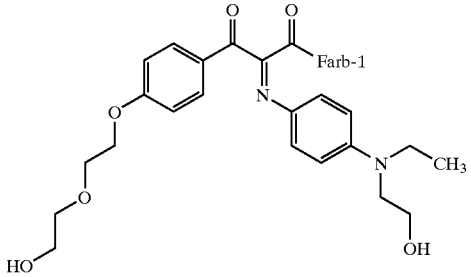
(Farb-2)29
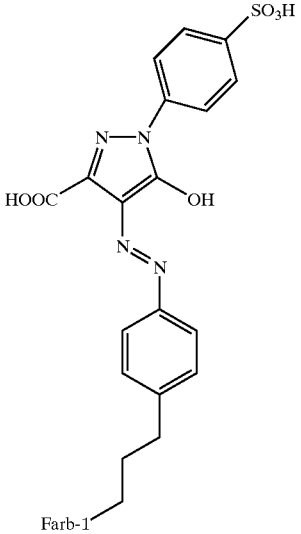
(Farb-2)30
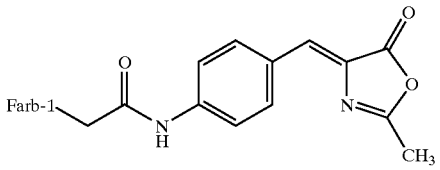
(Farb-2)31
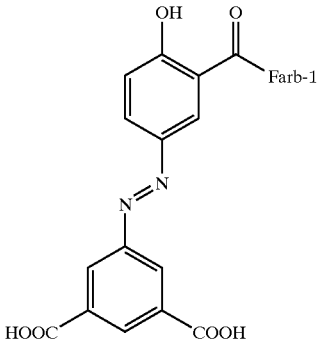
Examples of Kup
Kup1
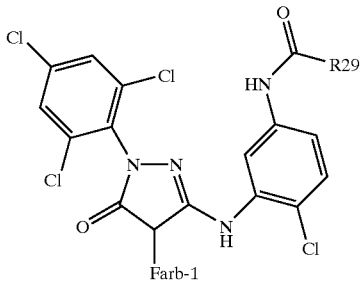
$R_{29}$ =
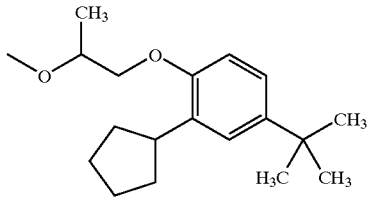

-continued
Kup2
$R_{29}$ =
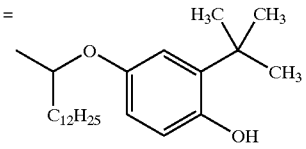
Kup3
$R_{29}$ =
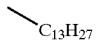
Kup4
$R_{29}$ =
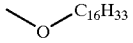
Kup5
$R_{29}$ =
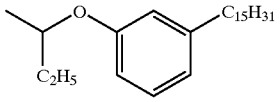
Kup6
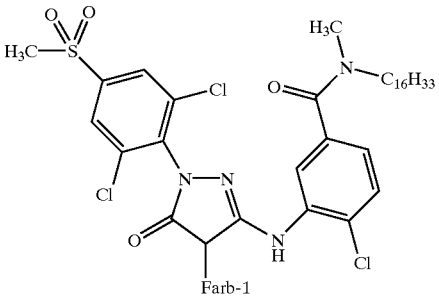
Kup7
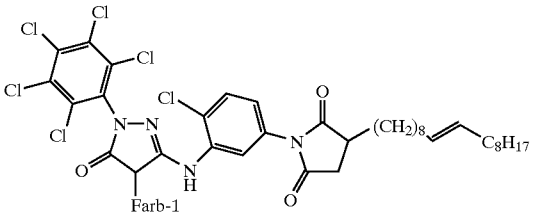
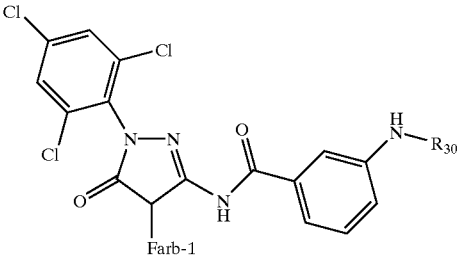
Kup8
$R_{30}$ =
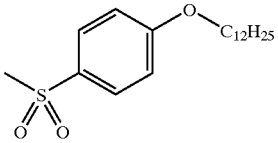
Kup9
$R_{30}$ =
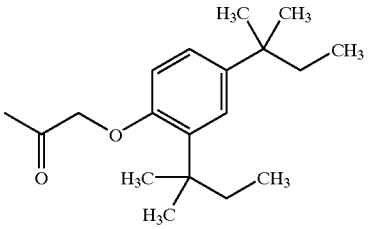
Kup10
$R_{30}$ =
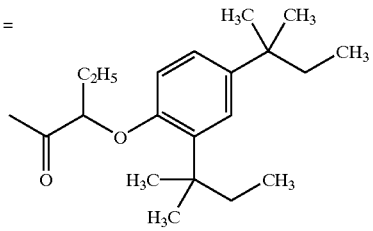
Kup11
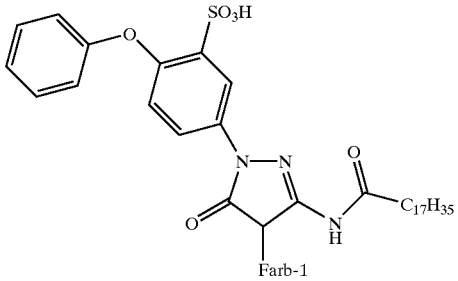

-continued
Kup12
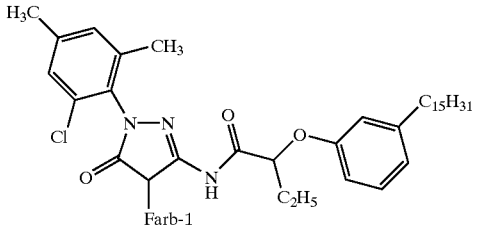
Kup13
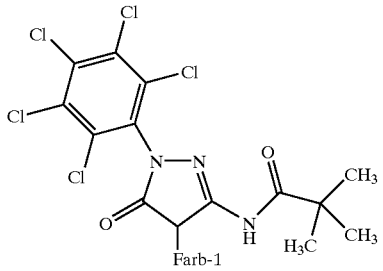
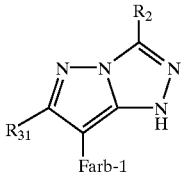
Kup14
$R_{31}$ = 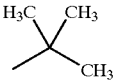
$R_{32}$ = 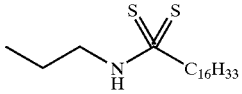
Kup15
$R_{31}$ = 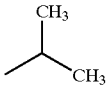
$R_{32}$ = 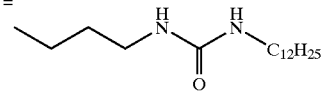
Kup16
$R_{31}$ = 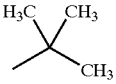
$R_{32}$ = 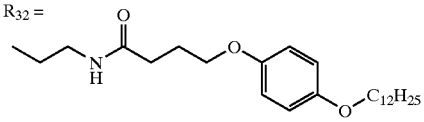
Kup17
$R_{31}$ = 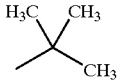
$R_{32}$ = 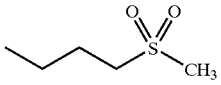
Kup18
$R_{31}$ = 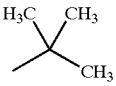
$R_{32}$ = 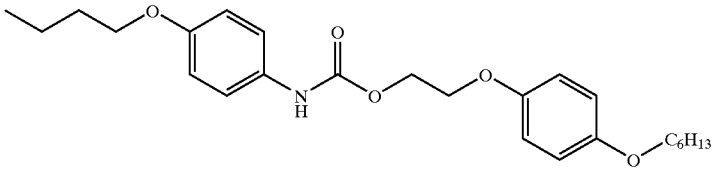
Kup19
$R_{31}$ = 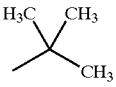
$R_{32}$ = 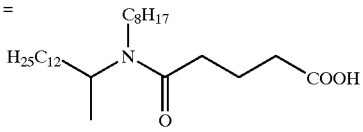
Kup20
$R_{31}$ = 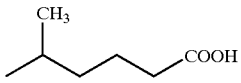
$R_{32}$ = 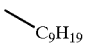
Kup21
$R_{31}$ = 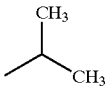
$R_{32}$ = 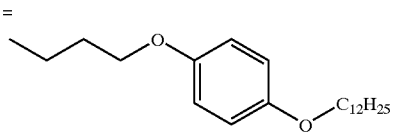
Kup22
$R_{31}$ = 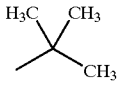
$R_{32}$ = 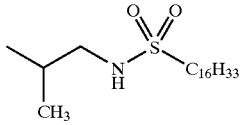

-continued
Kup23
$R_{31}$ =
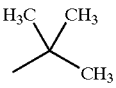
$R_{32}$ =
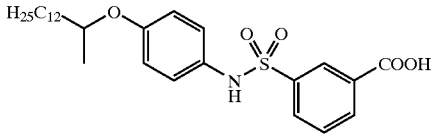
KuP24
$R_{31}$ =
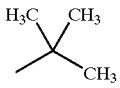
$R_{32}$ =
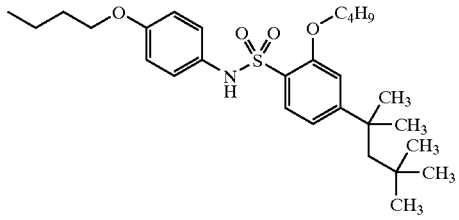
Kup25
$R_{31}$ =
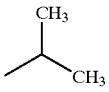
$R_{32}$ =
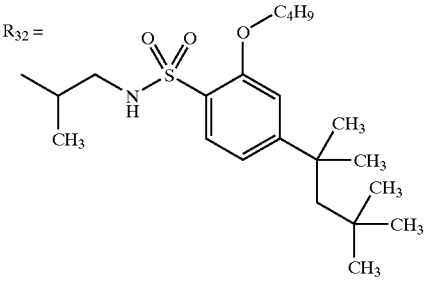
Kup26
$R_{31}$ =
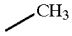
$R_{32}$ =
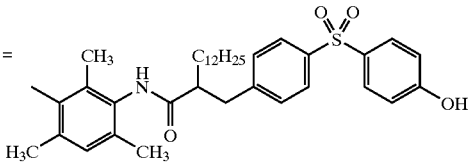
Kup27
$R_{31}$ =
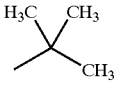
$R_{32}$=
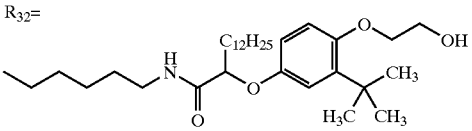
Kup28
$R_{31}$ =
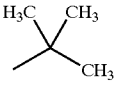
$R_{32}$=
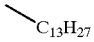
Kup29
$R_{31}$ =
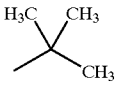
$R_{32}$=
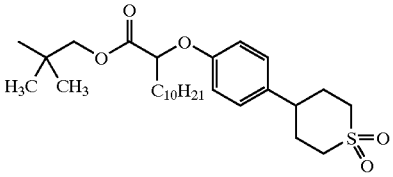
Kup30
$R_{31}$ =
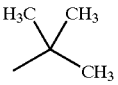
$R_{32}$=
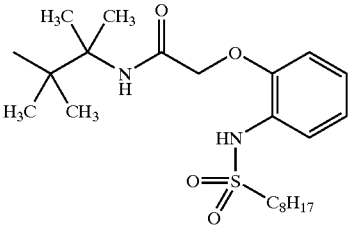
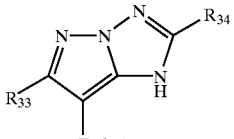
Farb-1

-continued
Kup31
$R_{33}$ =
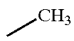
$R_{34}$ =
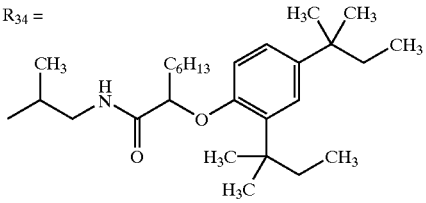
Kup32
$R_{33}$ =
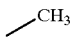
$R_{34}$ =
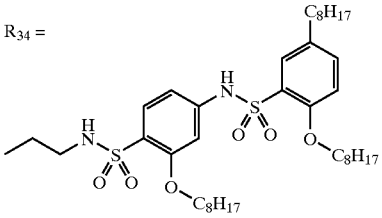
Kup33
$R_{33}$ =
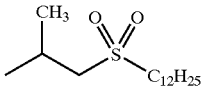
$R_{34}$ =
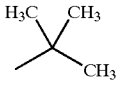
Kup34
$R_{33}$ =
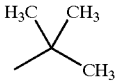
$R_{34}$ =
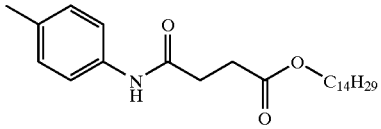
Kup35
$R_{33}$ =
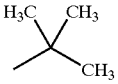
$R_{34}$ =
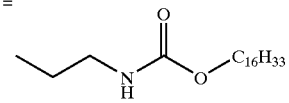
Kup36
$R_{33}$ =
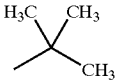
$R_{34}$ =
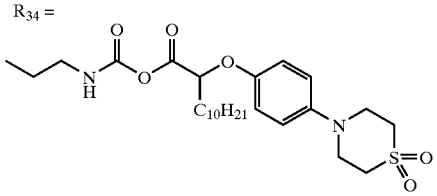
Kup37
$R_{33}$ =
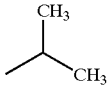
$R_{34}$ =
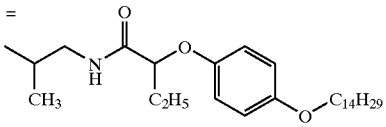
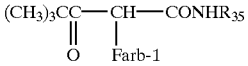
Kup38
$R_{35}$ =
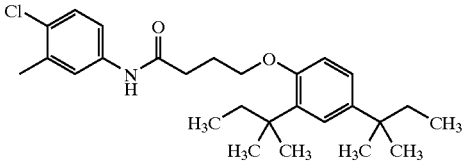
Kup39
$R_{35}$ =
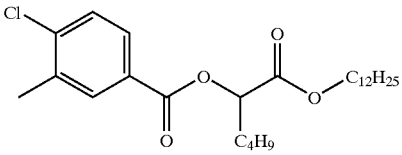
Kup40
$R_{35}$ =
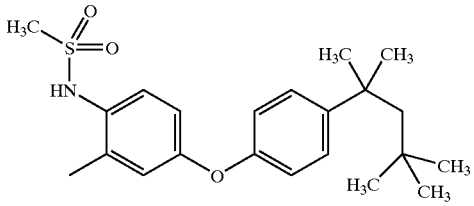
Kup41
$R_{35}$ =
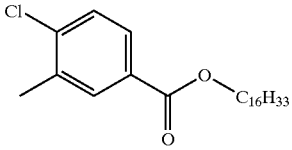
Kup42
$R_{35}$ =
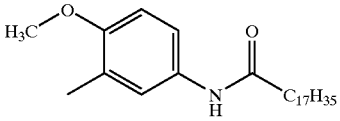

-continued
Kup43
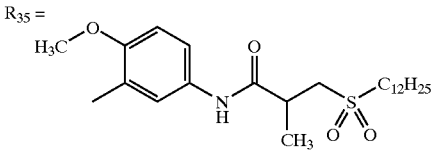
Kup44
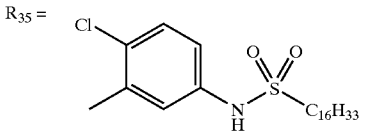
Kup45
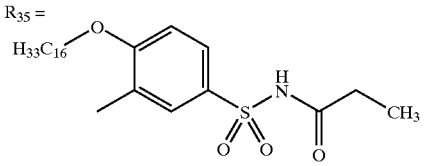
Kup46
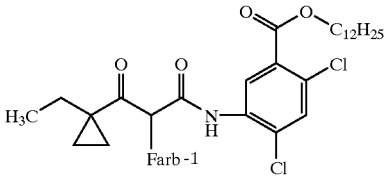
Kup47
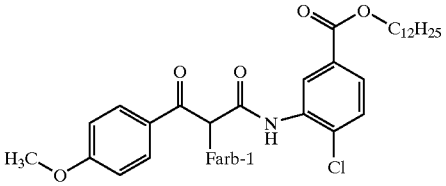
Kup48
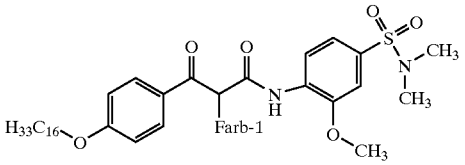
Kup49
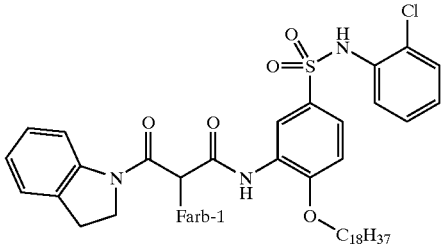
Kup50
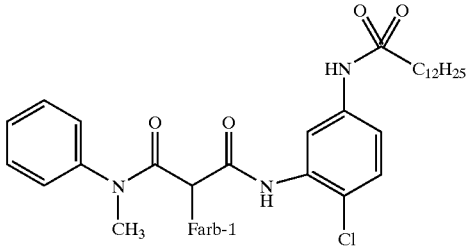
Kup51
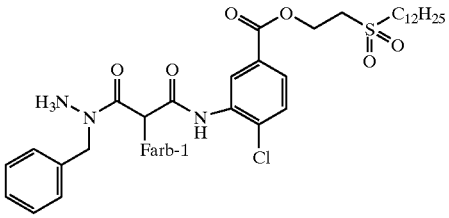
Kup52
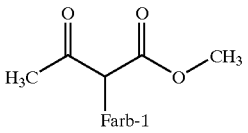
Kup53
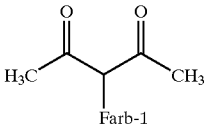
Kup54
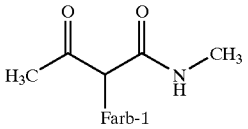
Kup55
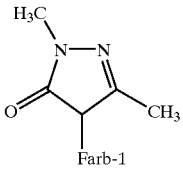
Kup56
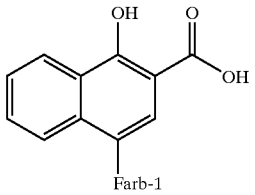

-continued

Kup57

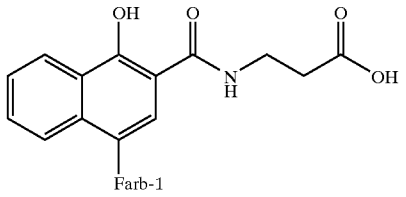

Kup58

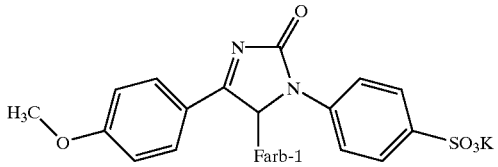

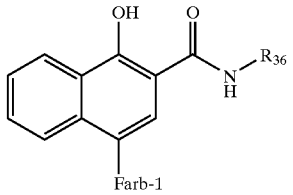

Kup59

$R_{36}$ =

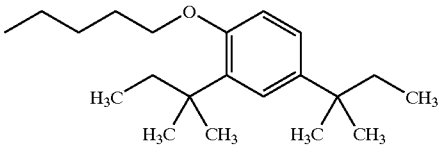

Kup60

$R_{36}$ =

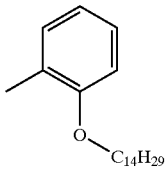

KuP61

$R_{36}$ =

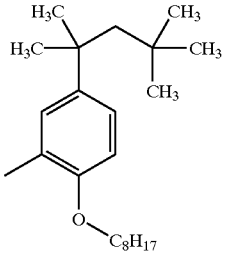

Kup62

$R_{36}$ =

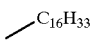

Kup63

$R_{36}$ =

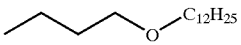

Kup64

$R_{36}$ =

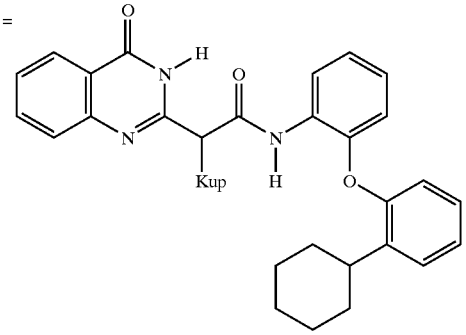

Examples of Masking Couplers

| No. | Type | Kup | Farb-1 | Farb-2 |
|---|---|---|---|---|
| MK1 | yellow/cyan –> magenta | Kup3 | (Farb-1)1 | (Farb-2)4 |
| MK2 | yellow/cyan –> magenta | Kup3 | (Farb-1)4 | (Farb-2)8 |
| MK3 | yellow/cyan –> magenta | Kup3 | (Farb-1)4 | (Farb-2)9 |
| MK4 | yellow/cyan –> magenta | Kup3 | (Farb-1)4 | (Farb-2)10 |
| MK5 | yellow/cyan –> magenta | Kup3 | (Farb-1)4 | (Farb-2)4 |
| MK6 | yellow/cyan –> magenta | Kup4 | (Farb-1)2 | (Farb-2)20 |
| MK7 | yellow/cyan –> magenta | Kup2 | (Farb-2)3 | (Farb-2)12 |
| MK8 | yellow/cyan –> magenta | Kup10 | (Farb-1)8 | (Farb-2)15 |
| MK9 | yellow/cyan –> magenta | Kup17 | (Farb-1)6 | (Farb-2)1 |
| MK10 | yellow/cyan –> magenta | Kup34 | (Farb-1)5 | (Farb-2)7 |
| MK11 | yellow/cyan –> magenta | Kup5 | (Farb-1)14 | (Farb-2)28 |
| MK12 | yellow/yellow –> magenta | Kup3 | (Farb-1)3 | (Farb-2)27 |

-continued

| No. | Type | Kup | Farb-1 | Farb-2 |
|---|---|---|---|---|
| MK13 | yellow/yellow –> magenta | Kup3 | (Farb-1)4 | (Farb-2)30 |
| MK14 | cyan/cyan –> magenta | Kup1 | (Farb-1)14 | (Farb-2)10 |
| MK15 | yellow/magenta –> cyan | Kup59 | (Farb-1)12 | (Farb-2)21 |
| MK16 | yellow/yellow –> cyan | Kup60 | (Farb-1)4 | (Farb-2)25 |
| MK17 | magenta/magenta –> cyan | Kup62 | (Farb-1)10 | (Farb-2)24 |
| MK18 | magenta/cyan –> yellow | Kup47 | (Farb-1)13 | (Farb-2)2 |

Synthesis of Compound MK-1 (Kup 3 (Farb-1)1-(Farb-2)4)
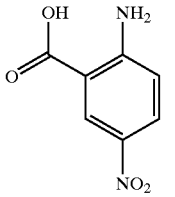
1
+
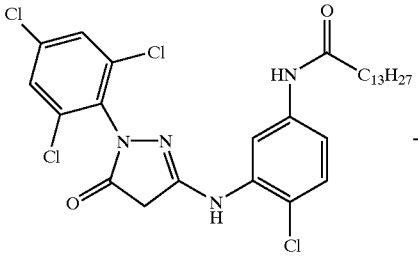
2
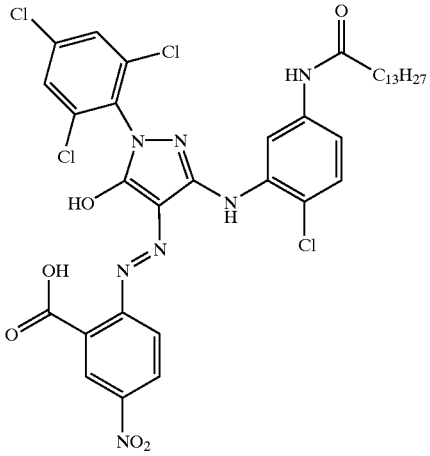
3
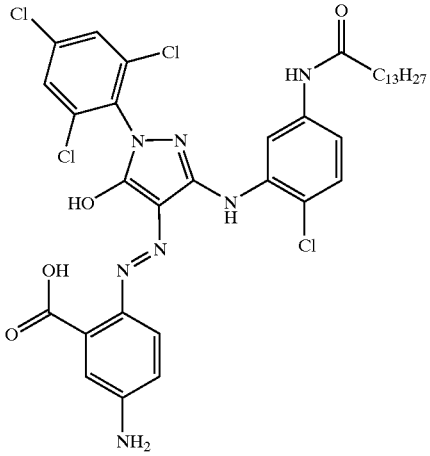
4
-continued
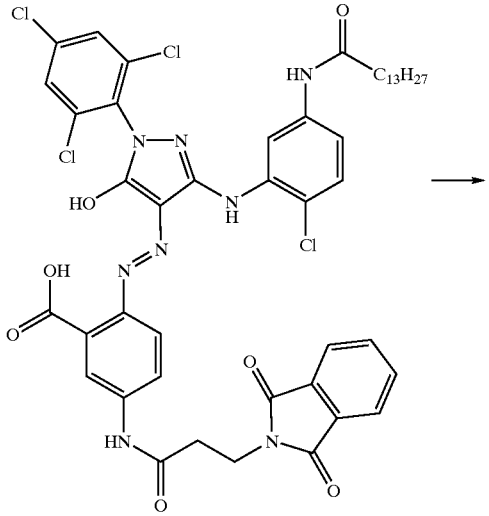
5
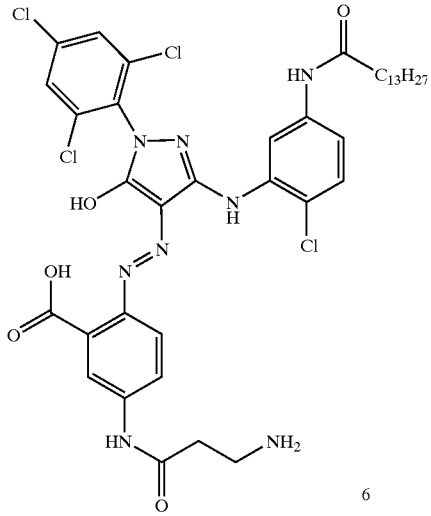
6
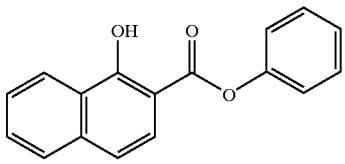
7
+
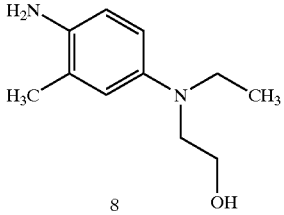
8

-continued

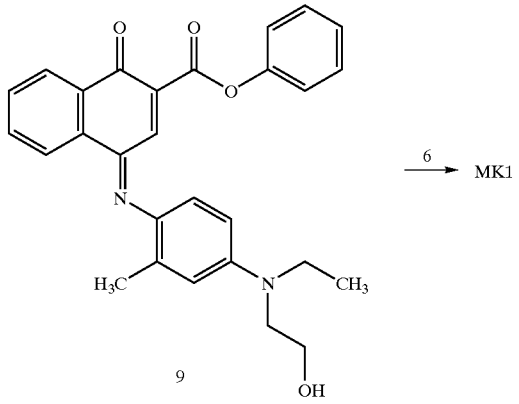

Synthesis of Masking Coupler MK-1 (Kup3-(Farb-1)1-(Farb-2)4)

Synthesis of Compound 3

4.6 g (25 mmol) of 2-amino-5-nitrobenzoic acid (2) are suspended in 20 ml of water and 5 ml of conc. hydrochloric acid and combined at 0–5° C. with a solution of 1.9 g (27.5 mmol) of sodium nitrite in 4 ml of water. After 30 minutes' stirring at the same temp., the suspension is introduced at room temp. into a solution of 15.3 g (25 mmol) of magenta coupler 1 in 250 ml of pyridine. After 1 hour's stirring, the mixture is poured onto ice and hydrochloric acid. The solid is removed by suction filtration, washed with water and decocted with n-propanol. 19.0 g of an orange solid are obtained.

Synthesis of Compound 4

9.2 g (11.4 mmol) of nitro compound 3 are refluxed in 90 ml of n-propanol and slowly combined with a solution of 9.3 g (38.6 mmol) of sodium sulfide nonahydrate in 30 ml of water. After a further 2 hours' stirring with refluxing, the cooled solution is combined with 11 ml of glacial acetic acid and stirred overnight. The solid is removed by suction filtration and washed once with n-propanol and once with water. 6.8 g of a red solid are obtained.

Synthesis of Compound 5

9.6 g (12.4 mmol) of amine 4 are dissolved in 120 ml of dimethylacetamide and slowly combined dropwise at room temp. with a solution of 3.6 g (15 mmol) of 3-phthalimidopropionyl chloride in 15 ml of tetrahydrofuran. After 30 minutes' stirring at room temp., the mixture is heated to 50–60° C. for 4 hours. The cooled mixture is poured onto ice and hydrochloric acid. The solid is removed by suction filtration and washed with water. 12.4 g of an orange solid are obtained.

Synthesis of Compound 6

11.0 g (11.3 mmol) of phthalimide 5 are suspended in 250 ml of ethanol, combined with 3.75 g (75 mmol) of hydrazine hydrate and refluxed for 4 hours. The solid is removed from the hot reaction mixture by suction filtration and washed with ethanol. 8.8 g of an orange solid are obtained.

Synthesis of Compound 9

26.4 g (100 mmol) of naphthsalol (7) are dissolved in 950 ml of methanol and combined at 0–5° C. in succession with 119 ml of 30% sodium methylate solution, a solution of 41.6 g (122 mmol) of 4-(N-ethyl-N-hydroxyethylamino)-2-methylaniline sesquisulfate (8, CD4) in 55 ml of water and dropwise with a solution of 56.1 g (246 mmol) of ammonium peroxydisulfate in 380 ml of water. After 2 hours' stirring at the same temp., the solid is removed by suction filtration, washed in succession with ice-cold methanol and with water and recrystallised from ethanol. 27.8 g of a deep blue solid are obtained.

Synthesis of Compound MK1

2.2 g (2.6 mmol) of amine 6 are dissolved in 20 ml of dimethylacetamide and 0.26 g (2.6 mmol) of triethylamine and combined at room temp. with 1.2 g (2.6 mmol) of dye 9. The mixture is stirred for 0.5 h at 80–100° C. and, after cooling in ice water, a little acetic acid is poured in. The solid is removed by suction filtration, washed and purified chromatographically on silica gel. 1.4 g of the green masking coupler MK1 are obtained, the $10^{-4}$ molar solution of which in 3:7 phenoxyethanol/methanol has absorption maxima at 426 nm and 695 nm.

Examples of color photographic materials are color negative films, color reversal films, color positive films, color photographic paper, color reversal photographic paper, color-sensitive materials for the dye diffusion transfer process or the silver dye bleaching process. A review may be found in Research Disclosure 37038 (1995) and Research Disclosure 38957 (1996).

The photographic materials consist of a support, onto which at least one photosensitive silver halide emulsion layer is applied. Suitable supports are in particular thin films and sheets. A review of support materials and auxiliary layers applied to the front and reverse sides thereof is given in Research Disclosure 37254, part 1 (1995), page 285 and in Research Disclosure 38957, part XV (1996), page 627.

The color photographic materials conventionally contain at least one red-sensitive, one green-sensitive and one blue-sensitive silver halide emulsion layer, optionally together with interlayers and protective layers.

Depending upon the type of photographic material, these layers may be differently arranged. This is demonstrated for the most important products:

Color photographic films such as color negative films and color reversal films have on the support, in the stated sequence, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. The layers of identical spectral sensitivity differ with regard to their photographic sensitivity, wherein the less sensitive sublayers are generally arranged closer to the support than the more highly sensitive sublayers.

A yellow filter layer is conventionally located between the green-sensitive and blue-sensitive layers which prevents blue light from penetrating into the underlying layers.

Possible options for different layer arrangements and the effects thereof on photographic properties are described in J. Inf. Rec. Mats., 1994, volume 22, pages 183–193 and in Research Disclosure 38957, part XI (1996), page 624.

It is known to incorporate additional color correction layers of a spectrally differently sensitised silver halide emulsion between the blue-sensitive and green-sensitive or between the green-sensitive and red-sensitive layers from EP 550 110, U.S. Pat. Nos. 5,270,152, 5,389,499, 4,306,015, 4,705,744, EP 167 173.

Color photographic paper, the preferred readout sensor, which is usually substantially less photosensitive than a color photographic film, conventionally has on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; the yellow filter layer may be omitted.

The number and arrangement of the photosensitive layers may be varied in order to achieve specific results. For example, all high sensitivity layers may be grouped together in one package of layers and all low sensitivity layers may be grouped together in another package of layers in a photographic film in order to increase sensitivity (DE-25 30 645).

The substantial constituents of the photographic emulsion layers are binder, silver halide grains and color couplers.

Details of suitable binders may be found in Research Disclosure 37254, part 2 (1995), page 286 and in Research Disclosure 38957, part II.A (1996), page 598.

Details of suitable silver halide emulsions, the production, ripening, stabilisation and spectral sensitisation thereof, including suitable spectral sensitisers, may be found in Research Disclosure 37254, part 3 (1995), page 286, in Research Disclosure 37038, part XV (1995), page 89 and in Research Disclosure 38957, part V.A (1996), page 603.

Photographic materials with camera sensitivity conventionally contain silver bromide-iodide emulsions, which may optionally contain small proportions of silver chloride. Photographic print materials contain either silver chloride-bromide emulsions containing up to 80 mol % of AgBr or silver chloride-bromide emulsions containing above 95 mol % of AgCl.

Details of color couplers may be found in Research Disclosure 37254, part 4 (1995), page 288, in Research Disclosure 37038, part II (1995), page 80 and in Research Disclosure 38957, part X.B (1996), page 616. The maximum absorption of the dyes formed from the couplers and the color developer oxidation product is preferably within the following ranges: yellow coupler 430 to 460 nm, magenta coupler 540 to 560 run, cyan coupler 630 to 700 nm.

In order to improve sensitivity, grain, sharpness and color separation in color photographic films, compounds are frequently used which, on reaction with the developer oxidation product, release photographically active compounds, for example DIR couplers which eliminate a development inhibitor.

Details relating to such compounds, in particular couplers, may be found in Research Disclosure 37254, part 5 (1995), page 290, in Research Disclosure 37038, part XIV (1995), page 86 and in Research Disclosure 38957, part X.C (1996), page 618.

Color couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 $\mu$m in diameter) in the layers.

Suitable high-boiling organic solvents, methods for the introduction thereof into the layers of a photographic material and further methods for introducing chemical compounds into photographic layers may be found in Research Disclosure 37254, part 6 (1995), page 292.

The non-photosensitive interlayers generally arranged between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in Research Disclosure 37254, part 7 (1995), page 292, in Research Disclosure 37038, part III (1995), page 84 and in Research Disclosure 38957, part X.D (1996), pages 621 et seq.

The photographic material may also contain UV light absorbing compounds, optical brighteners, spacers, filter dyes, formalin scavengers, light stabilisers, antioxidants, $D_{min}$ dyes, plasticisers (latices), biocides and additives to improve coupler and dye stability, to reduce color fogging and to reduce yellowing, and others. Suitable compounds may be found in Research Disclosure 37254, part 8 (1995), page 292, in Research Disclosure 37038, parts IV, V, VI, VII, X, XI and XIII (1995), pages 84 et seq. and in Research Disclosure 38957, parts VI, VIII, IX and X (1996), pages 607 and 610 et seq.

The layers of color photographic materials are conventionally hardened, i.e. the binder used, preferably gelatine, is crosslinked by appropriate chemical methods.

Suitable hardener substances may be found in Research Disclosure 37254, part 9 (1995), page 294, in Research Disclosure 37038, part XII (1995), page 86 and in Research Disclosure 38957, part II.B (1996), page 599.

Once exposed with an image, color photographic materials are processed using different processes depending upon their nature. Details relating to processing methods and the necessary chemicals are disclosed in Research Disclosure 37254, part 10 (1995), page 294, in Research Disclosure 37038, parts XVI to XXIII (1995), pages 95 et seq. and in Research Disclosure 38957, parts XVIII, XIX and XX (1996), pages 630 et seq. together with example materials.

The present invention also provides the production of a color photographic image by at least the steps exposure, development, bleaching, fixing and drying of a material according to the invention, wherein bleaching and fixing may also be combined into bleach/fixing, characterised in that development is performed with a p-phenylenediamine developer. p-Phenylenediamine developers are known; CD-3 and CD-4 are preferred.

EXAMPLE 1

Comparison Material B-1

A color photographic recording material for color negative development (layer structure 1A) was produced by applying the following layers in the stated sequence onto a transparent layer support of cellulose triacetate. Quantities are stated in each case per 1 $m^2$. The silver halide application rate is stated as the corresponding quantities of $AgNO_3$; the silver halides are stabilised with 0.5 g of 4-hydroxy-6-methyl-1,3,3a,7-tetraazaindene per mol of $AgNO_3$.

1st layer (anti-halo layer)

| | | |
|---|---|---|
| 0.3 | g | of black colloidal silver |
| 1.2 | g | of gelatine |
| 0.3 | g | of UV absorber UV-1 |

-continued

| | |
|---|---|
| 0.2 g | of DOP (developer oxidation product) scavenger SC-1 |
| 0.02 g | of tricresyl phosphate (TCP) |
| | 2nd layer (low-sensitivity red-sensitive layer) |
| 0.7 g | of $AgNO_3$ of a spectrally red-sensitised AgBrI emulsion, 4 mol% iodide, average grain diameter 0.42 μm |
| 1 g | of gelatine |
| 0.35 g | of colourless coupler C-1 |
| 0.05 g | of coloured coupler RC-1 |
| 0.03 g | of coloured coupler YC-1 |
| 0.36 g | of TCP |
| | 3rd layer (medium-sensitivity red-sensitive layer) |
| 0.8 g | of $AgNO_3$ of a spectrally red-sensitised AgBrI emulsion, 5 mol% iodide, average grain diameter 0.53 μm |
| 0.6 g | of gelatine |
| 0.15 g | of colourless coupler C-2 |
| 0.03 g | of coloured coupler RC-1 |
| 0.02 g | of DIR coupler D-1 |
| 0.18 g | of TCP |
| | 4th layer (high-sensitivity red-sensitive layer) |
| 1 g | of $AgNO_3$ of a spectrally red-sensitised AgBrI emulsion, 6 mol% iodide, average grain diameter 0.85 μm |
| 1 g | of gelatine |
| 0.1 g | of colourless coupler C-2 |
| 0.005 g | of DIR coupler D-2 |
| 0.11 g | of TCP |
| | 5th layer (interlayer) |
| 0.8 g | of gelatine |
| 0.07 g | of DOP scavenger SC-2 |
| 0.06 g | of aurintricarboxylic acid aluminium salt |
| | 6th layer (low-sensitivity green-sensitive layer) |
| 0.5 g | of $AgNO_3$ of a spectrally green-sensitised AgBrI emulsion, 4 mol% iodide, average grain diameter 0.35 μm |
| 0.8 g | of gelatine |
| 0.3 g | of colourless coupler M-1 |
| 0.09 g | of coloured coupler YM-1 |
| 0.02 g | of DIR coupler D-6 |
| 0.52 g | of TCP |
| | 7th layer (medium-sensitivity green-sensitive layer) |
| 1.5 g | of $AgNO_3$ of a spectrally green-sensitised AgBrI emulsion, 4 mol% iodide, average grain diameter 0.50 μm |
| 1 g | of gelatine |
| 0.2 g | of colourless coupler M-1 |
| 0.07 g | of coloured coupler YM-1 |
| 0.015 g | of DIR coupler D-5 |
| 0.285 g | of TCP |

-continued

| | |
|---|---|
| | 8th layer (high-sensitivity green-sensitive layer) |
| 2.0 g | of $AgNO_3$ of a spectrally green-sensitised AgBrI emulsion, 6 mol% iodide, average grain diameter 0.70 μm |
| 1.1 g | of gelatine |
| 0.05 g | of colourless coupler M-2 |
| 0.05 g | of coloured coupler YM-2 |
| 0.005 g | of DIR coupler D-4 |
| 0.1 g | of TCP |
| | 9th layer (yellow filter layer) |
| 0.09 g | of yellow dye GF-1 |
| 1 g | of gelatine |
| 0.08 g | of DOP scavenger SC-2 |
| 0.26 g | of TCP |
| | 10th layer (low-sensitivity blue-sensitive layer) |
| 0.3 g | of $AgNO_3$ of a spectrally blue-sensitised AgBrI emulsion, 6 mol% iodide, average grain diameter 0.44 μm |
| 0.5 g | of $AgNO_3$ of a spectrally blue-sensitised AgBrI emulsion, 6 mol% iodide, average grain diameter 0.50 μm |
| 1.9 g | of gelatine |
| 1.1 g | of colourless coupler Y-1 |
| 0.037 g | of DIR coupler D-6 |
| 0.6 g | of TCP |
| | 11th layer (high-sensitivity blue-sensitive layer) |
| 0.6 g | of $AgNO_3$ of a spectrally blue-sensitised AgBrI emulsion, 7 mol% iodide, average grain diameter 0.95 μm |
| 1.2 g | of gelatine |
| 0.1 g | of colourless coupler Y-1 |
| 0.006 g | of DIR coupler D-3 |
| 0.11 g | of TCP |
| | 12th layer (micrate layer) |
| 0.1 g | of $AgNO_3$ of a micrate AgBrI emulsion, 0.5 mol% iodide, average grain diameter 0.06 μm |
| 1 g | of gelatine |
| 0.004 mg | of $K_2[PdCl_4]$ |
| 0.4 g | of UV absorber UV-2 |
| 0.3 g | of TCP |
| | 13th layer (protective and hardening layer) |
| 0.25 g | of gelatine |
| 0.75 g | of hardener H-1 |

Once hardened, the overall layer structure had a swelling factor of ≦3.5. Substances used in Example 1:

UV-1

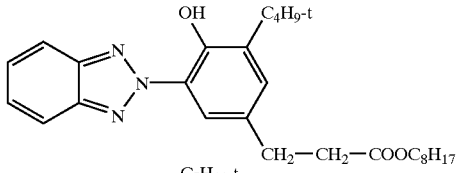

UV-2

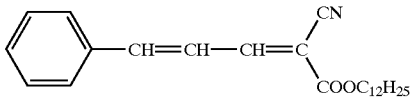

C-1

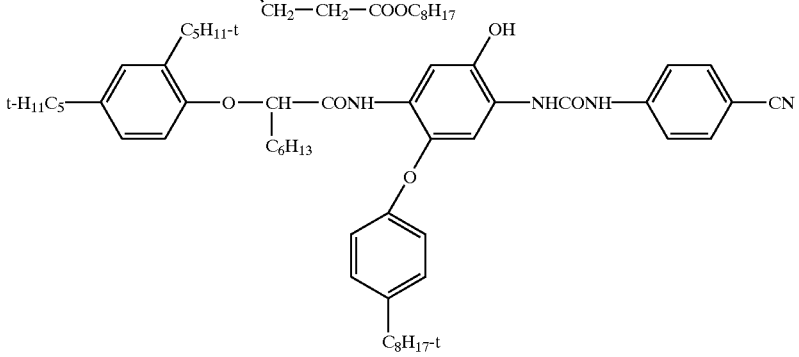

-continued
C-2
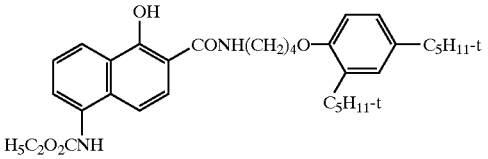
RC-1
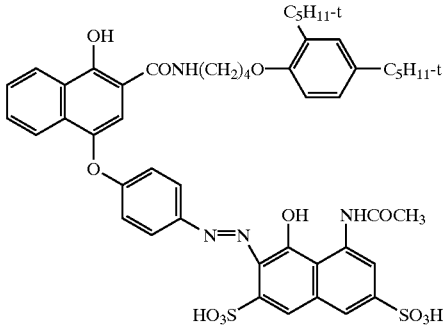
YC-1
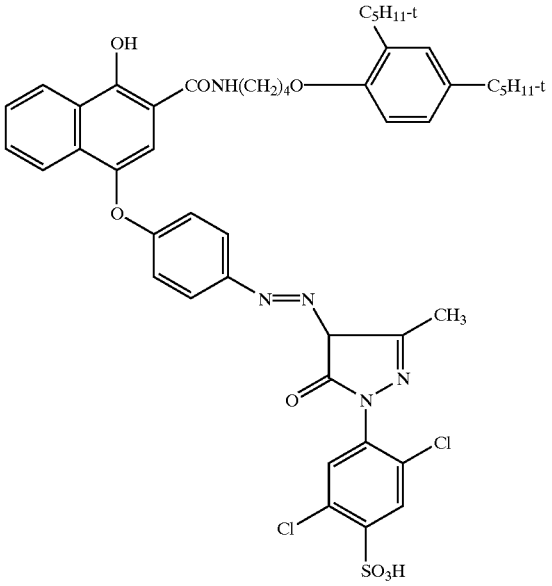
M-1
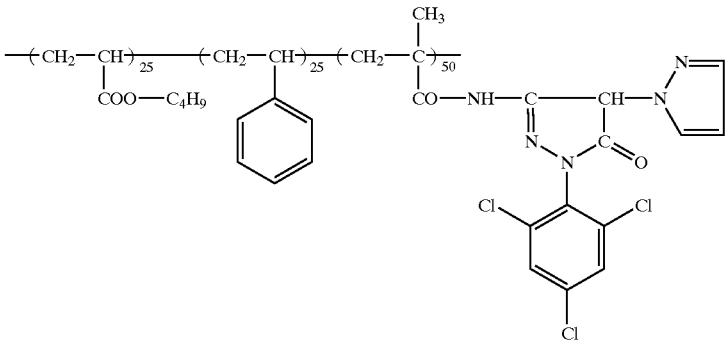
M-2
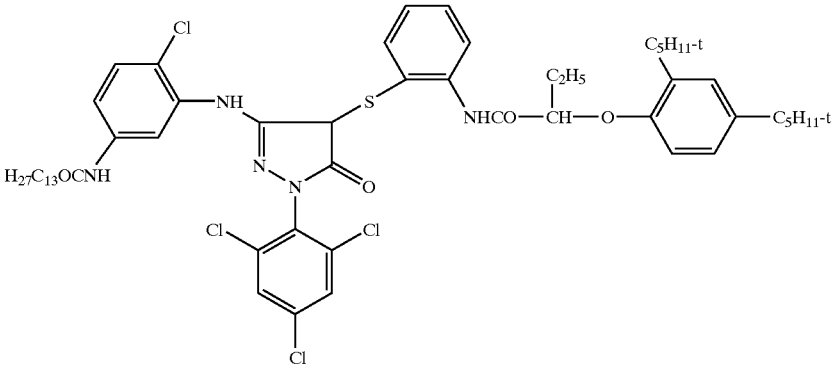

-continued
YM-1
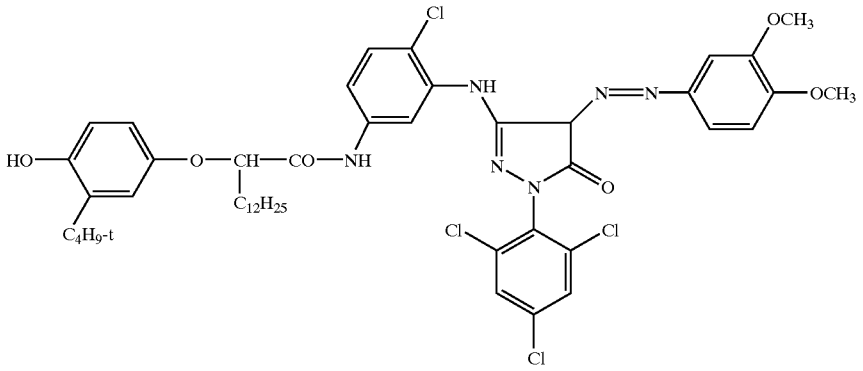
YM-2
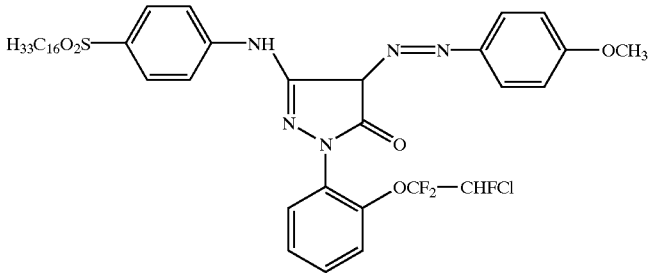
Y-1
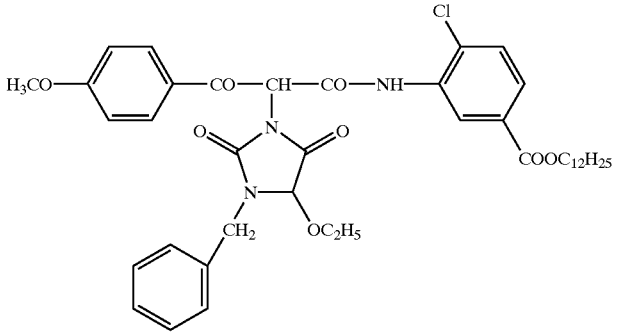
D-1
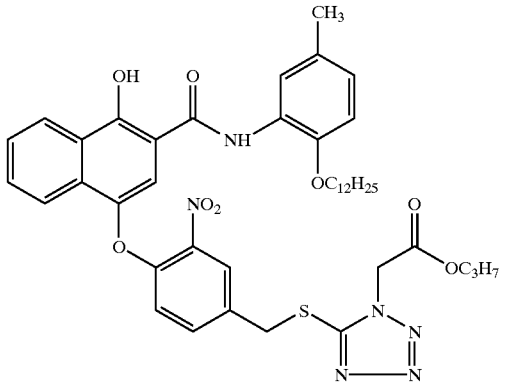
D-2
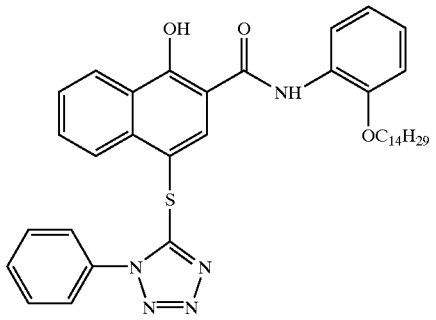

-continued
D-3
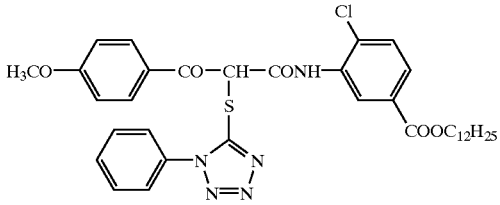
D-4
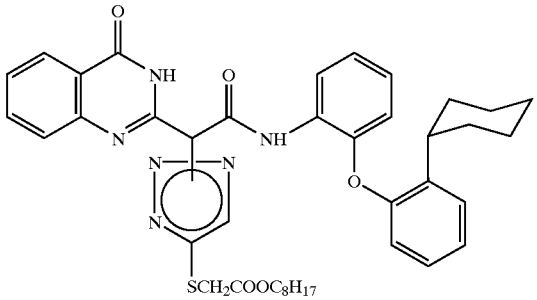
D-5
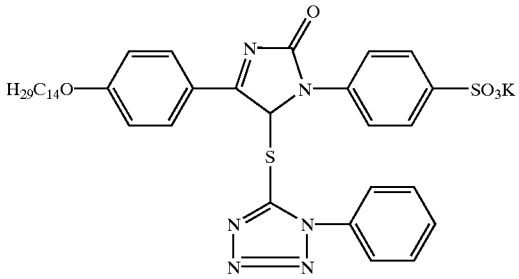
D-6
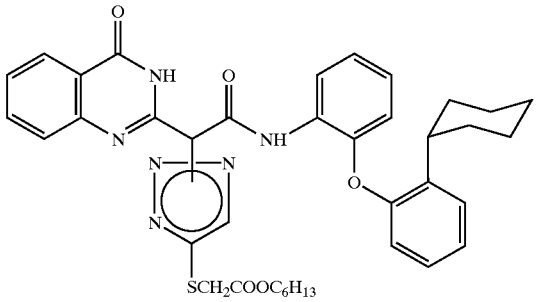
SC-1
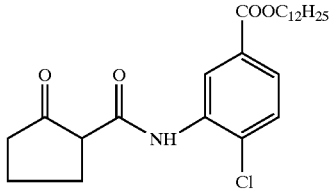
SC-2
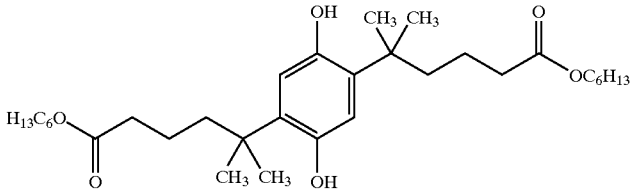
GF-1
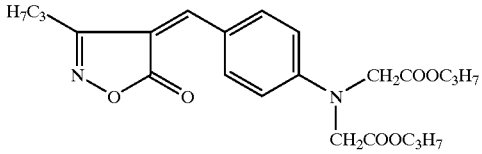
H-1
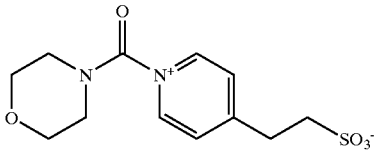

After exposure with a grey wedge, the material is developed in accordance with "The British Journal of Photography", 1974, pages 597 and 598.

Table 1 below shows the changes in materials B-2 (comparison), B-3a and b (invention) and B-4a and b (invention) in comparison with material B-1 in the green-sensitive layers, together with the results obtained therewith and comments thereon.

TABLE 1

| | AgX application rate in AgNO3 equivalents | | | Coupler application rate | | | DIR coupler application rate | | | yellow->magenta mask application rate | | |
|---|---|---|---|---|---|---|---|---|---|---|---|---|
| | | | | M-2 | M-1 | M-1 | D-4 | D-5 | D-6 | YM-2 | YM-1 | YM-1 |
| Ex. | high-sensitivity layer | medium-sensitivity layer | Low-sensitivity layer | high-sensitivity layer | medium-sensitivity layer | low-sensitivity layer | high-sensitivity layer | medium-sensitivity layer | low-sensitivity layer | high-sensitivity layer | medium-sensitivity layer | low-sensitivity layer |
| B-1 | 2 $g/m^2$ | 1.5 $g/m^2$ | 0.5 $g/m^2$ | 50 $mg/m^2$ | 200 $mg/m^2$ | 300 $mg/m^2$ | 5 $mg/m^2$ | 15 $mg/m^2$ | 5 $mg/m^2$ | 50 $mg/m^2$ | 70 $mg/m^2$ | 90 $mg/m^2$ |
| B-2 | 1.5 $g/m^2$ | 1 $g/m^2$ | 0.5 $g/m^2$ | 30 $mg/m^2$ | 125 $mg/m^2$ | 200 $mg/m^2$ | — | 5 $mg/m^2$ | — | 55 $mg/m^2$ | 75 $mg/m^2$ | 100 $mg/m^2$ |
| B-3 a/b | 1.5 $g/m^2$ | 1 $g/m^2$ | 0.5 $g/m^2$ | 20 $mg/m^2$ | 115 $mg/m^2$ | 150 $mg/m^2$ | — | 5 $mg/m^2$ | — | — | — | — |
| B-4 a/b | 2 $g/m^2$ | 1.5 $g/m^2$ | 0.5 $g/m^2$ | 40 $mg/m^2$ | 175 $mg/m^2$ | 260 $mg/m^2$ | 5 $mg/m^2$ | 15 $mg/m^2$ | 5 $mg/m^2$ | — | — | — |

| | yellow->magenta mask application rate (= complementary mask) | | | Results | | | | |
|---|---|---|---|---|---|---|---|---|
| | MK-4/2 | MK-4/2 | MK-4/2 | | | | | |
| Ex. | high-sensitivity layer | medium-sensitivity layer | low-sensitivity layer | S (yellow) | S (magenta) | S (cyan) | IIE (yellow) | IIE (cyan) |
| B-1 | — | — | — | 3.70 | 3.60 | 3.55 | 130% | 140% |
| B-2 | — | — | — | 3.71 | 3.63 | 3.60 | 130% | 110% |
| B-3 a/b | 70 $mg/m^2$ | 110 $mg/m^2$ | 130 $mg/m^2$ | 3.71 (MK-4) | 3.61 (MK-4) | 3.54 (MK-4) | 130% (MK-4) | 140% (MK-4) |
| | | | | 3.70 (MK-2) | 3.60 (MK-2) | 3.53 (MK-2) | 125% (MK-2) | 145% (MK-2) |
| B-4 a/b | 65 $mg/m^2$ | 100 $mg/m^2$ | 120 $mg/m^2$ | 3.69 (MK-4) | 3.59 (MK-4) | 3.56 (MK-1) | 140% (MK-1) | 160% (MK-1) |
| | | | | 3.69 (MK-2) | 3.61 (MK-2) | 3.55 (MK-2) | 130% (MK-2) | 170% (MK-2) |

For both complementary masking couplers MK-4 and MK-2, B-3 exhibits identical IIE values to yellow and cyan as B-1 at a considerably lower silver application rate/$m^2$.
At an identical silver application rate (B-2), B-3 exhibits considerably greater inter-image effects.
Due to the addition of the complementary masking coupler according to the invention, B-4 exhibits, at the same silver application rate as B-1, considerably increased inter-image effects in comparison with B-1.
S = Sensitivity
IIE = Inter-image effect

What is claimed is:

1. A color photographic silver halide material which comprises a support, at least one blue-sensitive, yellow-coupling silver halide emulsion layer and at least one green-sensitive, magenta-coupling silver halide emulsion layer and at least one red-sensitive, cyan-coupling silver halide emulsion layer, and the silver halide material contains at least one masking coupler which has two chromophores which absorb in the wavelength range from 420 to 750 nm and are eliminable or decolorizable by coupling with a developer oxidation product.

2. The color photographic silver halide material according to claim 1, wherein said two chromophores absorb at an identical or very similar wavelengths.

3. The color photographic silver halide material according to claim 1, wherein said two chromophores absorb at different wavelengths.

4. The color photographic silver halide material according to claim 1, wherein the masking coupler exhibits an absorption maximum in two of the three ranges of the spectrum to which the color photographic material is sensitive.

5. The color photographic silver halide material according to claim 1, wherein the color photographic silver halide material is a color negative film.

6. The color photographic silver halide material according to claim 1, wherein the masking coupler is used in a green-sensitive layer.

7. The color photographic silver halide material according to claim 1, wherein the masking coupler is used in a blue-sensitive layer.

8. The color photographic silver halide material according to claim 1, wherein the masking coupler is used in a red-sensitive layer.

9. The color photographic silver halide material according to claim 1, wherein the at least one of said blue-sensitive silver halide emulsion layer, said green-sensitive silver halide emulsion layer and said red-sensitive silver halide emulsion layer is applied on the same side of the support.

10. The color photographic silver halide material according to claim 1, wherein the said at least one of said blue-sensitive silver halide emulsion layer and said at least one of said green-sensitive silver halide emulsion layer are applied onto one side of the support and said at least one of said red-sensitive silver halide emulsion layer onto the other side of the support.

11. The color photographic silver halide material according to claim 1, wherein the masking coupler is of the formula (I)

Kup-Farb-1-Farb-2 (I)

in which

Kup is the residue of the color coupler,

Farb-1 is the residue of a first chromophore, and

Farb-2 is the residue of a second chromophore.

12. The color photographic silver halide material according to claim 11, wherein Kup-Farb-1-Farb-2 is of one of the formula (II), (III), (IV) or (VI)

(II)

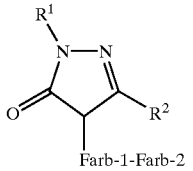

(III)

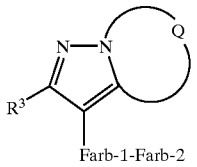

(IV)

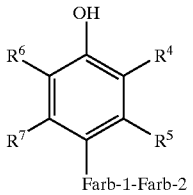

(VI)

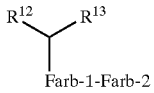

in which $R^1$ is unsubstituted phenyl or phenyl mono- or polysubstituted by halogen, alkyl, cyano, alkoxy, alkoxycarbonyl or acylamino, $R^2$ is alkylamino, arylamino, acylamino or carbamoylamino, $R^3$ is a hydrogen atom or a substituent, $R^4$ to $R^7$ are identical or different and are hydrogen atoms or substituents, wherein $R^4$ and $R^5$, or $R^6$ and $R^7$ are optionally linked together to form a ring, $R^{12}$ and $R^{13}$ are identical or different and are electron acceptor groups or heterocyclic groups, which are optionally joined together into a ring, Q is the non-metallic atoms to complete a 5-membered azole ring with 2 to 4 nitrogen atoms, which ring is optionally substituted.

13. The color photographic silver halide material according to claim 11, wherein Farb-1 is a dye or a fragment which forms a dye with Kup, which fragment is attached to the coupling position of Kup via a sulfur, nitrogen or oxygen atom, and optionally contains one or more time control members.

14. The color photographic silver halide material according to claim 11, wherein Farb-1 is a dye or a fragment which forms a dye with Kup, which fragment is attached to the coupling position of Kup via an azo group, and optionally contains one or more time control members.

15. The color photographic silver halide material according to claim 11, wherein Farb-2 is a chromophore having an absorbance coefficient at 690 nm which is at least 30% higher than at 620 nm.

16. The color photographic silver halide material according to claim 1, wherein Farb-2 is an azomethine dye comprising a coupler residue of the formulae (VII) to (XII) and a phenylenediamine developer moiety of the formula (XIII):

(VII)

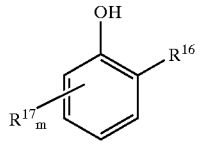

(VIII)

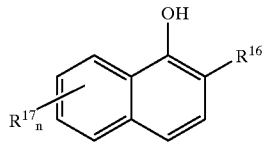

(IX)

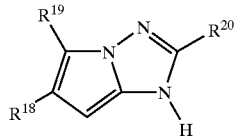

(X)

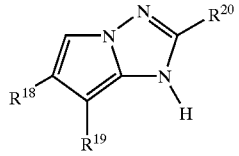

(XI)

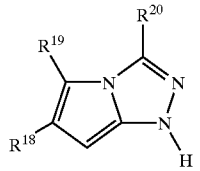

(XII)

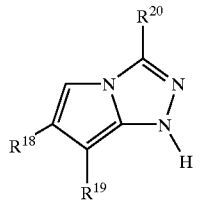

in which $R^{16}$ is H, $SO_2NR^{21}R^{22}$, $SO_3R^{21}$, $CO_2R^{21}$, $CONR^{21}R^{22}$, $NHCOR^{22}$, $NHCONR^{21}R^{22}$, $NHSO_2NR^{21}R^{22}$, $NHSO_2R^{21}$ or hetaryl, $R^{17}$ is a substituent, $R^{18}$, $R^{19}$, $R^{20}$, $R^{21}$ and $R^{22}$ mutually independently are H or a substituent, or $R^{18}$ and $R^{19}$, or $R^{21}$ and $R^{22}$ are linked together to form a ring, m is 0–2, n is 0–4, (XIII)

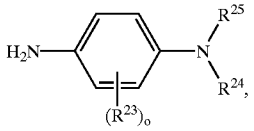

in which $R^{23}$ is a substituent, $R^{24}$ and $R^{25}$ are identical or different and are alkyl, aryl or hetaryl or $R^{23}$ and $R^{24}$ together or $R^{24}$ and $R^{25}$ together are the remaining members of a ring, and o is a number from 0 to 4 and Farb-2 is linked to Farb-1 with one of the substiuents $R^{16}$ to $R^{20}$ or $R^{23}$ to $R^{25}$ and one of the residues $R^{16}$ to $R^{20}$, $R^{23}$ to $R^{25}$ or the residue Farb-1, provided that it remains linked with Farb-2 after chromogenic development, contains at least one water-solubilizing group.

17. The color photographic silver halide material according to claim 1, wherein the at least one blue-sensitive silver halide emulsion layer is arranged closer to the light source than the at least one green-sensitive layer.

18. A process for the production of a photographic image which comprises the steps exposing, developing, bleaching, fixing and drying of the material according to claim 1, wherein said bleaching and said fixing may also be combined into bleach/fixing, and said developing is performed with a p-phenylenediamine developer.

19. The color photographic silver halide material according to claim 11, wherein Farb-1 is a fragment which, together with Kup, forms a dye.

20. The color photographic silver halide material according to claim 12, wherein $R^{12}$ and $R^{13}$ are identical or different and are acyl, alkoxycarbonyl, aryloxycarbonyl, carbamoyl, cyano, nitro, sulfamoyl, alkylsulfonyl, arylsulfonyl, aryl or heterocyclic groups which are optionally joined together to form a ring.

21. The color photographic silver halide material according to claim 16, wherein $R^{17}$ is acyl amino group and $R^{23}$ is alkyl, alkoxy and acylamino.

22. The color photographic silver halide material according to claim 16, wherein $R^{23}$ is alkyl, alkoxy or acylamino or $R^{23}$ and $R^{24}$ together, or $R^{24}$ and $R^{25}$ together form a 5-membered ring or a 6-membered ring.

* * * * *